US006386778B1

(12) United States Patent
Guay et al.

(10) Patent No.: US 6,386,778 B1
(45) Date of Patent: May 14, 2002

(54) SYSTEMS AND METHODS FOR DISPENSING MULTI-COMPONENT PRODUCTS

(75) Inventors: Gordon G. Guay, Chelmsford; Lorraine Blanchard, Newbury, both of MA (US); Harry Thompson, Culleoka, TN (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/755,666

(22) Filed: Jan. 5, 2001

(51) Int. Cl.[7] ..... A45D 40/04; A45D 40/24; A45D 40/26

(52) U.S. Cl. ..... 401/45; 206/219; 206/221; 222/390; 401/47; 401/98; 401/202; 401/262; 401/263

(58) Field of Search ..... 401/44–47, 98, 401/202, 262, 263; 206/219, 221; 222/390, 386

(56) References Cited

U.S. PATENT DOCUMENTS

| | | | | |
|---|---|---|---|---|
| 622,285 | A | 4/1899 | Sprain | |
| 970,224 | A | 9/1910 | Hoelzer | 388/61 |
| 1,617,922 | A | 2/1927 | Morrison | |
| 2,128,488 | A | 8/1938 | Koerner | 221/62 |
| 2,501,809 | A | 3/1950 | Capey | 222/545 |
| 2,555,459 | A | 6/1951 | Seufer | 222/561 |
| 2,618,411 | A | 11/1952 | Flaherty | 222/148 |
| 2,652,951 | A | 9/1953 | Esposito et al. | 222/142.1 |
| 2,663,468 | A | 12/1953 | Morrison | 222/517 |
| 2,699,885 | A | 1/1955 | McClure | 222/126 |
| 2,998,166 | A | 8/1961 | Klawiter | 222/189 |
| 3,029,002 | A | 4/1962 | Grefoire | 222/307 |
| 3,056,532 | A | 10/1962 | Germano | 222/361 |
| 3,169,675 | A | 2/1965 | Gutzmann et al. | 222/360 |
| 3,315,851 | A | 4/1967 | Ayotte | 222/559 |
| 3,782,608 | A | 1/1974 | Schneider | 222/368 |
| 3,850,347 | A | 11/1974 | Hill | 222/368 |
| 4,189,066 | A | 2/1980 | Berghahn | 222/48 |
| 4,368,184 | A | 1/1983 | Drucker et al. | 424/66 |
| 4,403,715 | A | 9/1983 | Ludovissie | 222/361 |
| 4,618,444 | A | * 10/1986 | Hudson et al. | 206/219 X |
| 4,626,119 | A | 12/1986 | Ladd, Jr. | 401/123 |
| 4,805,811 | A | 2/1989 | Wetterlin | 222/337 |
| 4,856,681 | A | 8/1989 | Murray | 222/158 |
| 4,957,219 | A | 9/1990 | Robbins et al. | 222/39 |
| 5,289,945 | A | 3/1994 | Stradder | 222/23 |
| 5,358,132 | A | 10/1994 | Bennett | 220/253 |
| 6,003,728 | A | * 12/1999 | Elliott | 206/219 X |
| D443,951 | S | 6/2001 | Look | |
| D444,264 | S | 6/2001 | Look | |
| D444,593 | S | 7/2001 | Look | |
| D444,913 | S | 7/2001 | Look | |
| D446,356 | S | 8/2001 | Look | |
| D446,606 | S | 8/2001 | Look | |
| D446,607 | S | 8/2001 | Look | |

* cited by examiner

*Primary Examiner*—Gregory L. Huson
*Assistant Examiner*—Kathleen J. Prunner
(74) *Attorney, Agent, or Firm*—Fish & Richardson P.C.

(57) ABSTRACT

A dispensing system is provided for a multi-component product. The dispensing system includes (a) a body, containing a first component of the product and having a dispensing end constructed to apply a portion of the first component to a surface; and (b) a cap, constructed to cover the dispensing end, containing a reservoir adapted to receive a second component of the product and being constructed to apply a portion of the second component to the dispensing end prior to applying the first component to the surface.

28 Claims, 11 Drawing Sheets

SYSTEMS AND METHODS FOR DISPENSING MULTI-COMPONENT PRODUCTS

TECHNICAL FIELD

This invention relates to systems and methods for dispensing multi-component products.

BACKGROUND

Antiperspirants, deodorants, and other personal care products are widely available in the form of solid or semi-solids sticks, gels and creams. The inactive ingredients used in these types of products, such as carriers/vehicles, emollients and structural agents (e.g., fatty alcohols and waxes), may inhibit or inactivate some of the active ingredients that would be desirable to use in the product. Thus, choices of ingredients for use in such products tend to be limited by issues of reactivity, other undesirable interaction between the ingredients, and syneresis (phase separation).

The ingredients selected for use in the product, and their relative proportions, may also be dictated by manufacturing constraints. For example, in order to obtain a product that is easily processed, it may be necessary to set the amount of a particular ingredient, e.g., fragrance, at a level that may not be optimal from a consumer standpoint. Moreover, temperature, shear or mixing may inactivate, entrap or volatilize certain ingredients.

In addition to these constraints, the formulator of personal care products is faced with the dilemma that product characteristics that are desirable to one consumer may be undesirable to another. For instance, different users may require different levels of deodorant or antiperspirant actives, or disagree on the optimal level of aesthetic modifiers such as fragrance. Moreover, different users have different body chemistries, which may result in different levels of effectiveness and comfort for a given product formulation.

SUMMARY

The present invention features dispensing systems that allow a component of a multicomponent product to be maintained separate from other components of the product until the product is applied by a user. The dispensing systems include a dispenser body and a cap constructed to cover a dispensing end of the body. The separated component, which may contain one or more ingredients, is stored in a reservoir in the cap, and is applied by the user to the dispensing end when the user is about to apply the product. For instance, the dispenser body may contain a stick antiperspirant product containing a relatively low level of an antiperspirant active (or even no antiperspirant active), and the cap may contain a supply of the antiperspirant active, e.g., in powdered form. Thus, the composition of the stick may contain inactive substances that are advantageous for production of a stick product, even though such substances would tend to inhibit the antiperspirant active. Moreover, the user can choose whether to apply the antiperspirant active that is in the cap, and in preferred implementations can adjust the amount applied, and thus can tailor the amount of antiperspirant active in the product to suit his or her needs.

Because one component of the product can be separated from others until the product is applied, ingredients can be used in the product that, if mixed and stored, would be reactive or otherwise incompatible. The product can also be formulated to contain a minimal amount of ingredients such as fragrance, which some users may not like, in the body side, and an additional amount in the cap side, so that users can choose whether to augment the amount of that ingredient that is in the product.

In some preferred implementations, the user can select a desired dose of the component to be delivered from the cap. For example, if an antiperspirant active is provided in the cap, a user who expects to be in a hot environment can apply a large dose of the antiperspirant active to the dispensing end, while a user expecting to be in a cooler environment can apply a smaller dose. Similarly, if a fragrance is provided in the cap, the user can adjust the amount of fragrance in the product to suit his or her taste by adjusting the amount dispensed from the cap.

In other preferred implementations, the cap reservoir is empty when the product is sold to the user, and the cap is constructed so that the user can charge the reservoir with a desired component. For example, the component in the body may be fragrance-free, enabling the user to add a favorite perfume or cologne to the cap reservoir and thus obtain a custom-scented product.

Advantageously, the ability to deliver a component to the dispensing end of a dispenser body containing another component can result in increased efficacy of the product, and in enhanced sensory attributes such as improved glide and decreased negative attributes such as stickiness and white residue (because ingredients that enhance glide and reduce stickiness and white residue can be used even if they would ordinarily inactivate the active ingredients of the product). In preferred implementations, product customization is also provided, allowing users to tailor the product attributes to suit their personal tastes, requirements and body chemistries.

In one aspect, the invention features a dispensing system for a multi-component product. The dispensing system includes (a) a body, containing a first component of the product and having a dispensing end constructed to apply a portion of the first component to a surface; and (b) a cap, constructed to cover the dispensing end, containing a reservoir adapted to receive a second component of the product and being constructed to apply a portion of the second component to the dispensing end prior to applying the first component to the surface.

Implementations of this aspect of the invention may include one or more of the following features. The first component is provided in a form selected from the group consisting of liquids, creams, gels, solids and semi-solids. The first component is provided in the form of a solid or semi-solid, and an end surface of the stick is exposed at the dispensing end. The first component is provided in the form of a liquid, and the dispensing end comprises a rolling ball constructed to deliver a film of the liquid to a surface. The first component is provided in the form of a liquid, and the dispensing end comprises a porous applicator, e.g., a foam or a sintered porous material. The first component is provided in the form of a gel, and the body includes a dispensing device for metering a dose of the gel to a dispensing surface at the dispensing end. The product is selected from the group consisting of antiperspirants, deodorants, antiperspirant/deodorants, toothpastes, sun screens, shaving preparations, aftershaves, condiments, soaps, candies, fabric softeners, laundry soaps, cosmetics, medications, paints, shoe polishes, floor cleaners, tub and tile cleaner, hair color treatments, window cleaners, and polishes and waxes. The second component is provided in the form of a powder or liquid. The second component is provided in the form of a compressed powder. The cap includes a dispensing device constructed to remove a portion of the powder using a grating action. The cap is constructed to deliver a predetermined dose of the second component onto the dispensing end when actuated by a user. The cap is constructed to allow the user to adjust the amount of the second component that is constructed to allow the user to adjust the amount of the second component that is delivered when the cap is actuated by a user. The cap, as supplied to the user, contains a supply of the second component in the reservoir. The cap includes an inlet constructed to allow a user to charge the reservoir with a supply of the second component. The second component is selected from the group consisting of antiperspirant actives, fragrances, anti-stain agents, anti-irritants, antiperspirant actives, deodorant actives, antimicrobials, anticaking agents, film formers, glide enhancers, emollients, anti-whitening agents, absorbents, binders, exfoliants, buffering agents, cooling agents, heating agents, co-salts, encapsulants, antioxidants, skin conditioning materials, humectants, reducing agents, oxidation agents, opacifying agents, and UV absorbing agents. The cap includes a dispensing mechanism for delivering the second component to the dispensing end. The dispensing system further includes an actuator to allow a user to actuate the application of the second component, or, alternatively, an actuator that is constructed to automatically apply the second component, e.g., when the cap is removed. The dispensing mechanism is selected from the group consisting of sprays, atomizers, droppers, and powder delivery devices. The first and second components are reactive with each other. An ingredient in the first component would tend to inactivate an ingredient in the second component during storage. The surface includes human skin, hair, tongue or oral cavity. Alternatively, the surface includes a fabric, leather, or plastic.

The invention also features a method of dispensing a multi-component product from a dispenser having a dispensing end that is covered by a cap when the dispenser is not in use and that is constructed to apply a first component of the product to a surface. The method includes (a) removing the cap, (b) applying a second component, contained in the cap, to the first component at the dispensing end to form the multi-component product; and (c) contacting a surface with the dispensing end to apply the multi-component product to the surface.

Preferred implementations of the method may include one or more of the following features. The surface includes human hair, skin, tongue or oral cavity. The applying step includes adjusting the amount of the second component to be applied to the dispensing end.

Other features and advantages of the invention will be apparent from the description and drawings, and from the claims.

DETAILED DESCRIPTION

Figure 1:
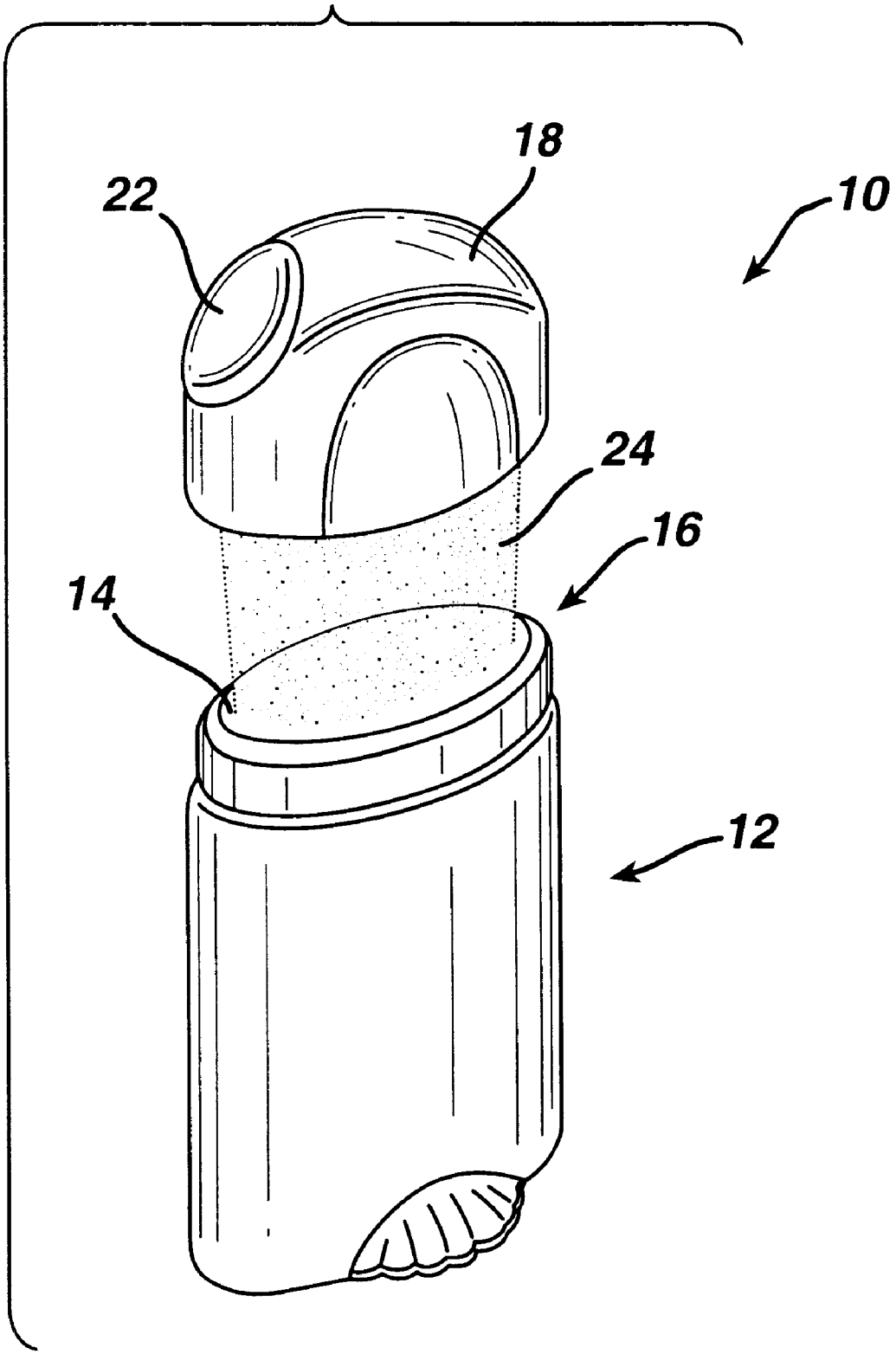
FIG. 1 is a schematic perspective view of a dispensing system according to one embodiment of the invention.

Referring to FIG. 1, a dispensing system 10 includes a dispenser body 12, containing a stick 14 (e.g., an antiperspirant) and having a dispensing end 16, and a cap 18 constructed to cover the dispensing end during storage. (While a stick is shown as an example, and discussed below, the body may contain, and the dispensing end may be adapted to dispense, any desired substance, e.g., a gel or liquid.)

The dispenser body includes an actuator (e.g., a rotatable knob) to allow the user to advance the stick towards the dispensing end as the stick is exhausted, as is well known in the antiperspirant art.

The cap includes an actuator 22 to allow the user to deliver a powder from a reservoir in the cap (not shown in FIG. 1) onto the stick 14 at the dispensing end 16. In this embodiment, pressing the actuator 22 causes a predetermined dose of the powder, set during manufacturing, to be delivered. Thus, while the user cannot deliver an amount that is less than the predetermined amount, the user can nonetheless deliver an amount in excess of the predetermined amount by pressing the actuator more than once, or deliver none of the powder by not pressing it at all. The predetermined amount can be varied by the manufacturer by varying the channel geometry, depth and/or length.

While the dispensing system 10 is shown delivering a powder in FIG. 1, liquids can also be delivered from the cap to the dispensing end, as will be discussed below with reference to FIGS. 6–7.

Alternative powder delivery mechanisms for dispensing powders from the cap are shown in FIGS. 2–4 and FIG. 5. Many other types of delivery mechanisms may be used, as will be apparent to those of skill in the art.

Figure 2:
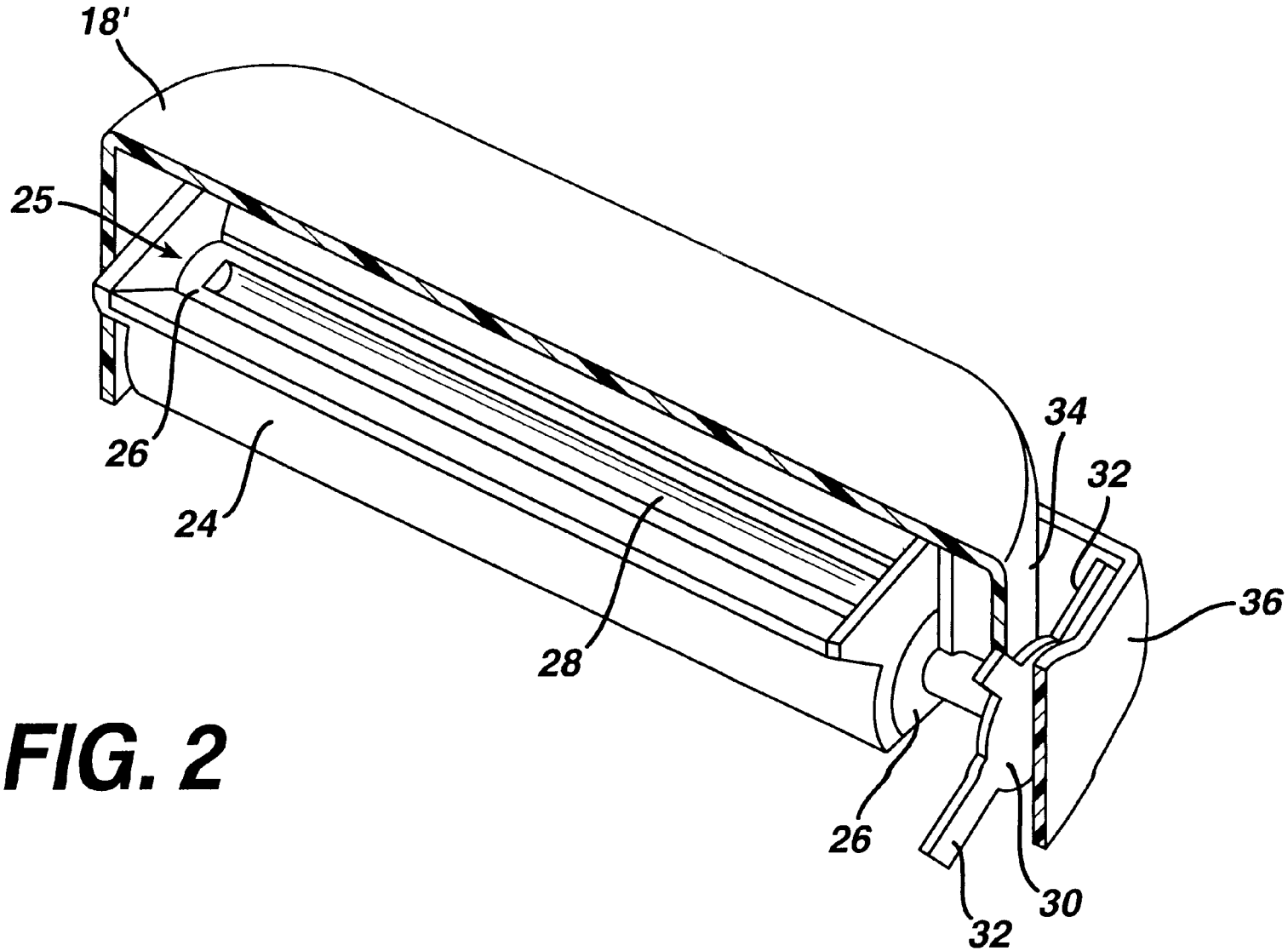
FIG. 2 is a perspective view of a cap for a dispensing system according to one aspect of the invention, with the front half removed.
Figure 3:
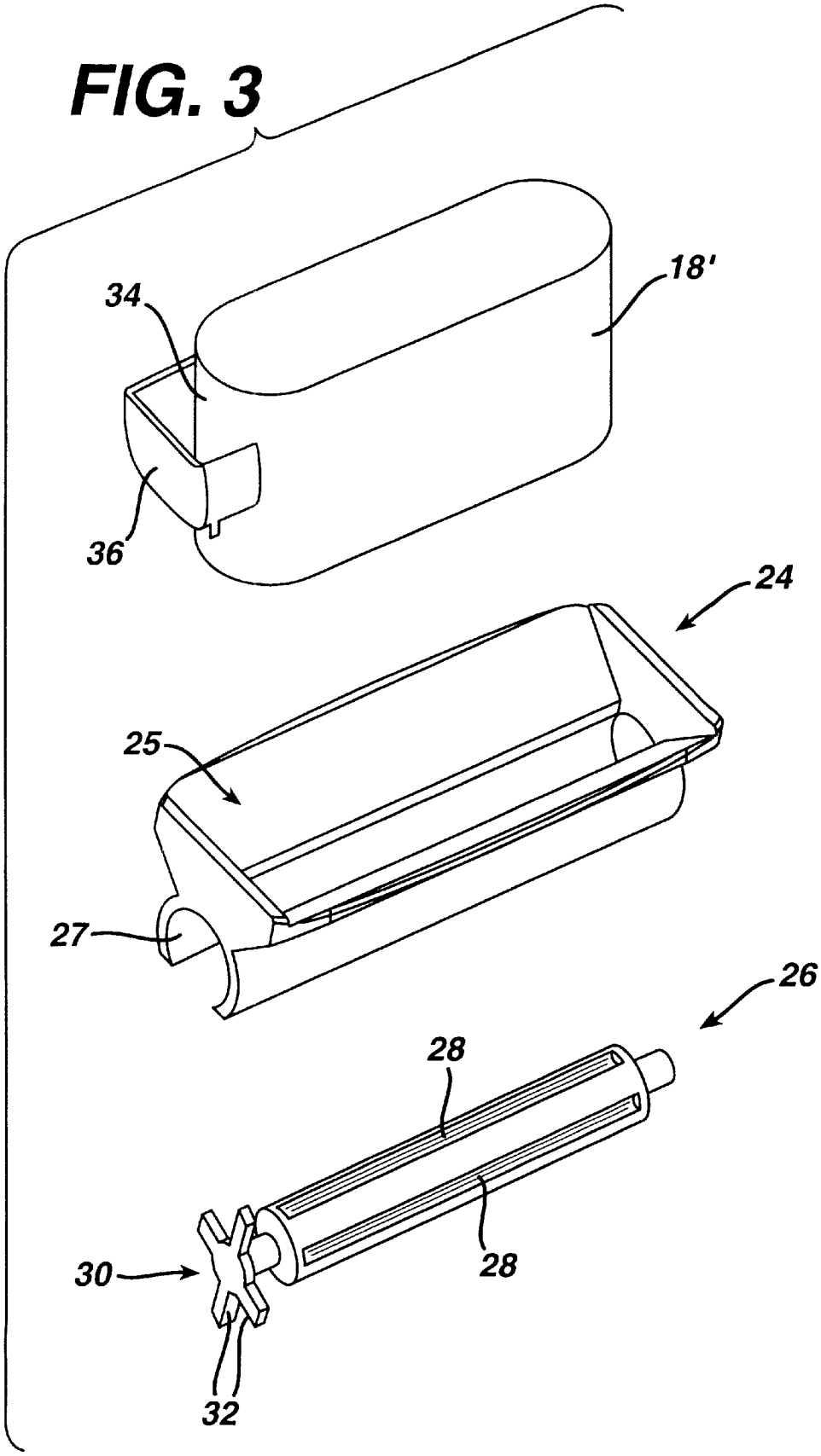
FIG. 3 is an exploded perspective view of the cap shown in FIG. 2.
Figure 4:
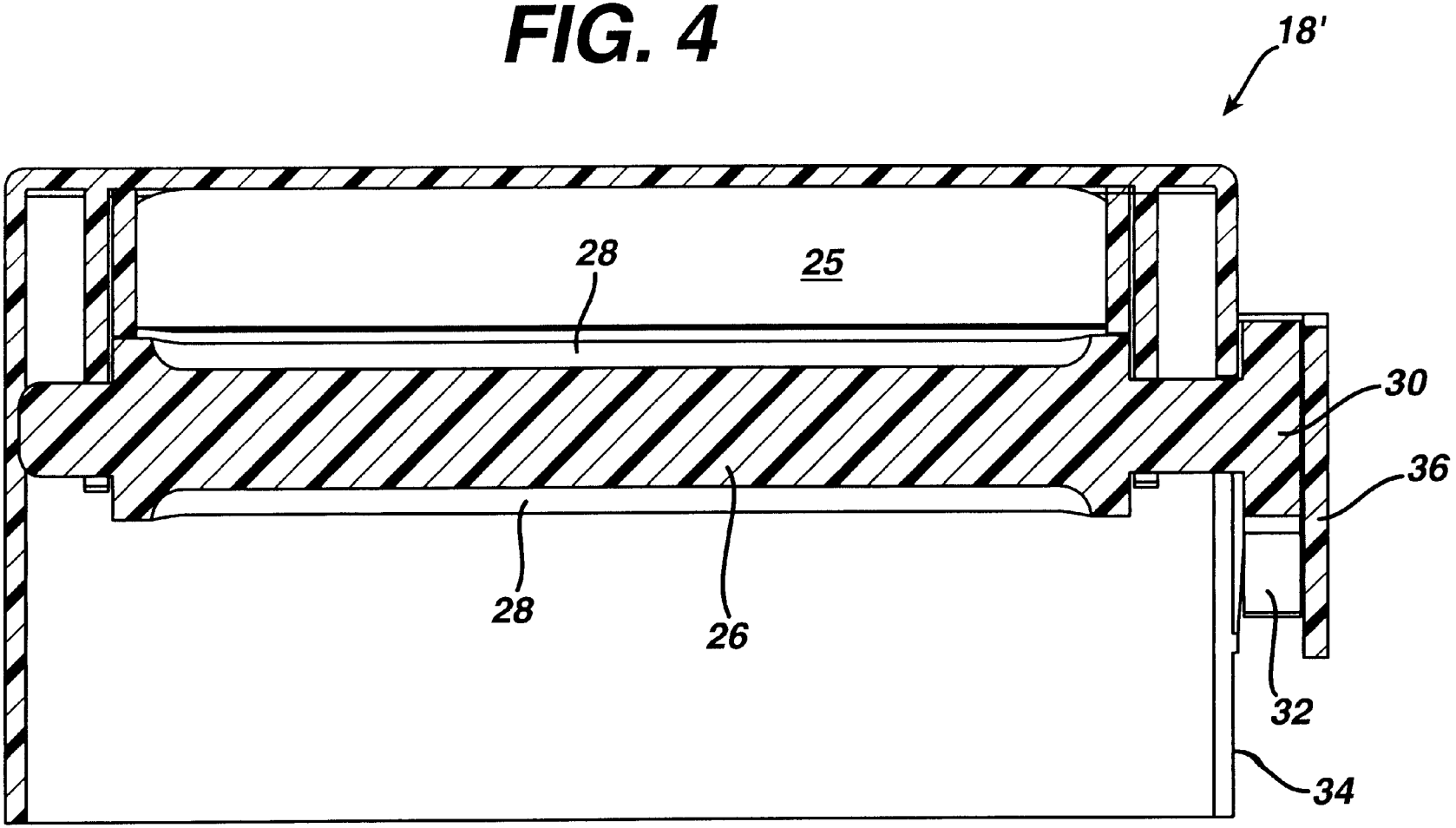
FIG. 4 is a cross-sectional view of the cap shown in FIG. 2.

Referring to FIGS. 2–4, cap 18' includes a powder reservoir 24 that defines a reservoir area 25, and is constructed to receive in rotatable engagement a cylindrical shaft 26 having a plurality of powder delivery channels 28. Shaft 26 also includes an actuation wheel 30 having a plurality of spokes 32. When the cap is assembled, as shown in FIG. 2, the actuation wheel 30 extends from a side surface 34 of the cap 18' and is protected by a shroud 36.

When the shaft 26 is aligned as shown in FIG. 2, two of the powder delivery channels 28 each contain a dose of powder, and the remaining two channels are empty. One of the full channels is within the reservoir area 25, and the other is facing the side wall 27 (FIG. 3) of powder reservoir 24. As a user rotates the wheel 30, the dose of powder in the delivery channel 28 that is facing side wall 27 is delivered from the cap, the delivery channel that was in the reservoir area 25 moves to face the side wall 27, and the next delivery channel is positioned in the reservoir area and filled.

As discussed above, while the minimum amount that can be dispensed is predetermined (the volume contained in a single delivery channel), the amount delivered can be varied by delivering multiple doses, i.e., by continuing to turn the wheel 30. For a wheel that includes four channels 28, each 90 degree rotation of the wheel would deliver a single dose of powder.

Figure 5:
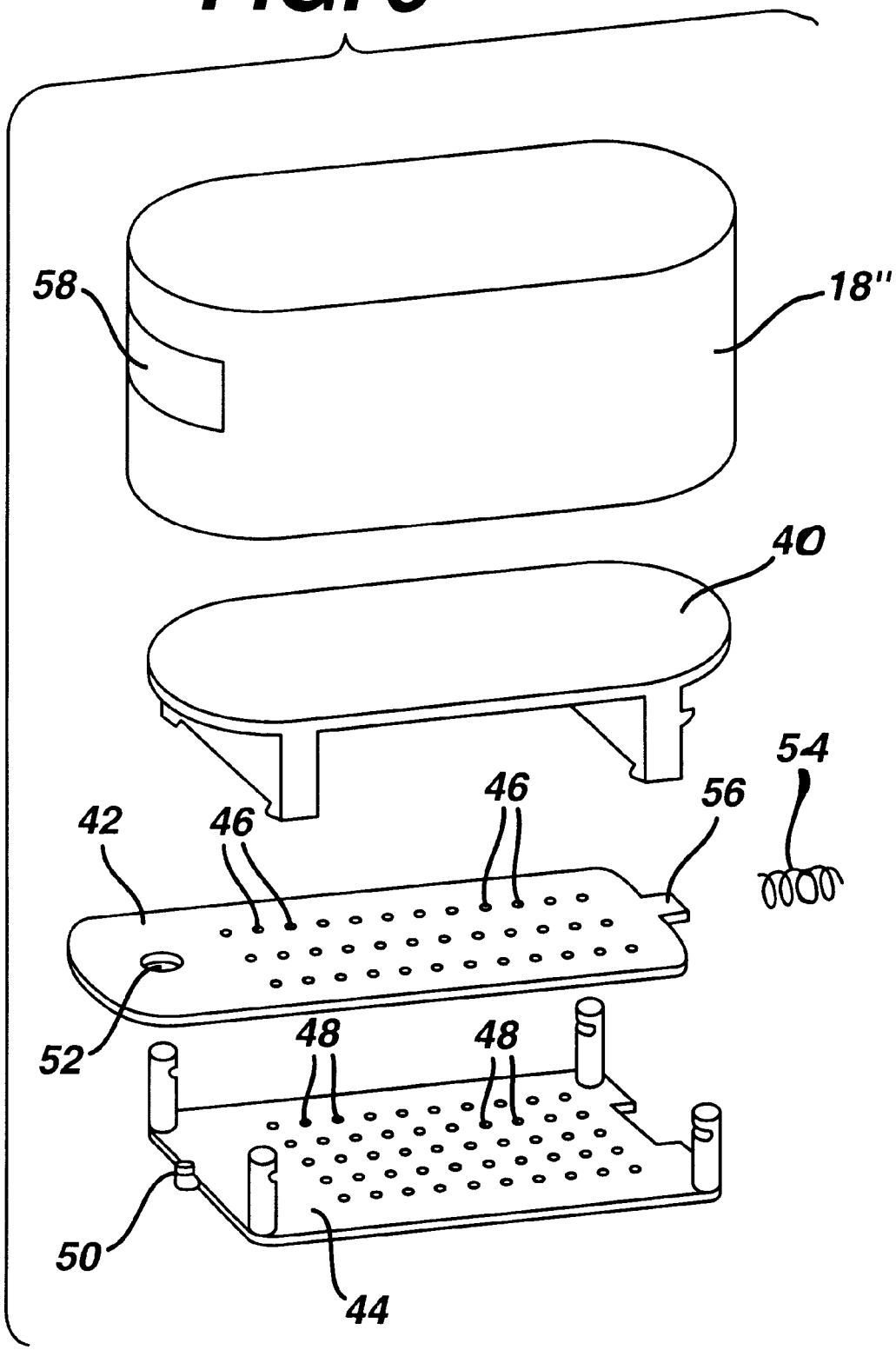
FIG. 5 is an exploded perspective view of a cap according to an alternative embodiment of the invention.
Figure 5A:
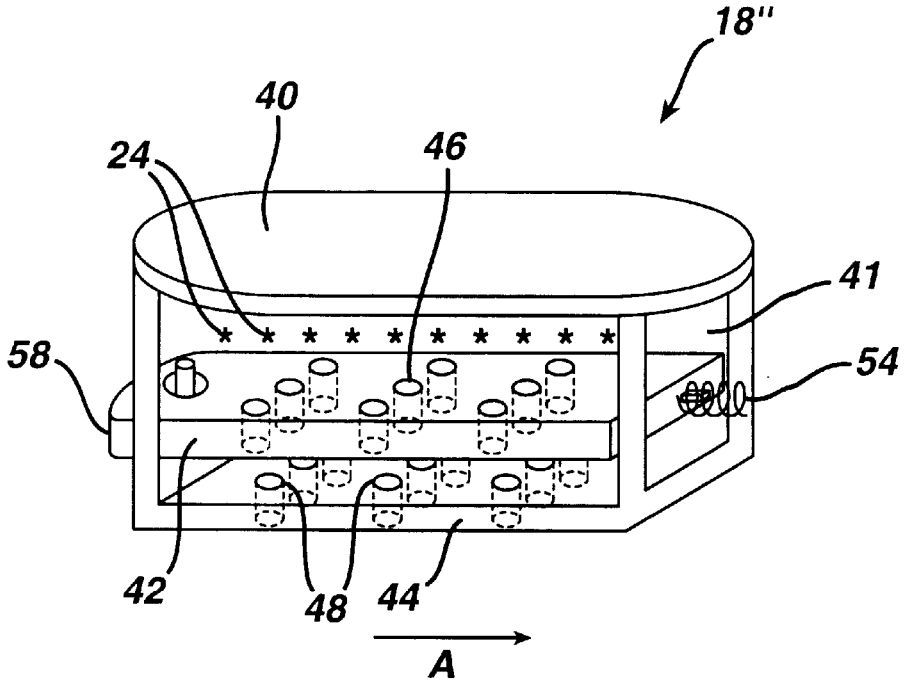
FIGS. 5A and 5B are schematic perspective views of the cap of FIG. 5, shown in its normal and dispensing positions, respectively.
Figure 5B:
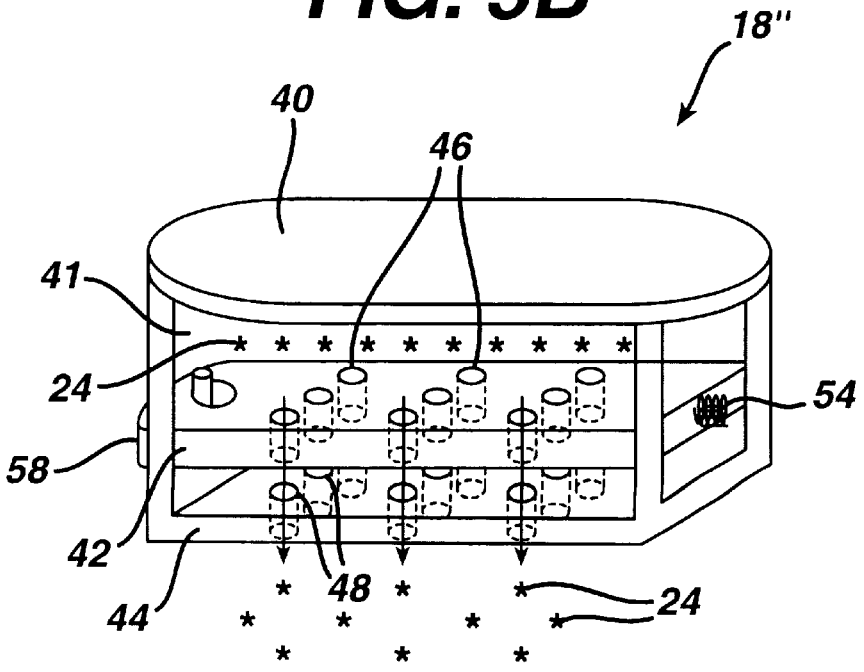

An alternate powder dispensing device is used in cap 18", shown in FIGS. 5–5B. This device includes a first plate 40 that defines the top surface of a powder reservoir 41 (FIG. 5A), and second and third plates 42, 44, each of which includes an array of apertures 46, 48. As shown in FIGS. 5A and 5B, plate 42 is mounted on plate 44 with protrusion 50 of plate 44 extending through slot 52 of plate 42 to allow transverse movement of plate 42 relative to plate 44. Plate 42 is biased towards a normal, "rest" position by spring 54, which is mounted on shaft 56 of plate 42. When the powder dispensing device is in its normal position (FIG. 5A), the apertures 46 are not registered with the apertures 48, and thus no powder is dispensed from the cap. When actuator 58 is pressed, plate 42 is moved transversely (arrow A, FIG. 5A), against the returning force of spring 54, until the apertures 46 and 48 are brought into registration (FIG. 5B), causing powder to be dispensed from the cap. When the actuator button is released, the spring 54 will return the plate 42 to its normal position, and no further powder will be dispensed. Thus, in this embodiment the user can determine how much powder is to be delivered by pressing the actuator 58 for a longer or shorter period of time.

Figure 6:
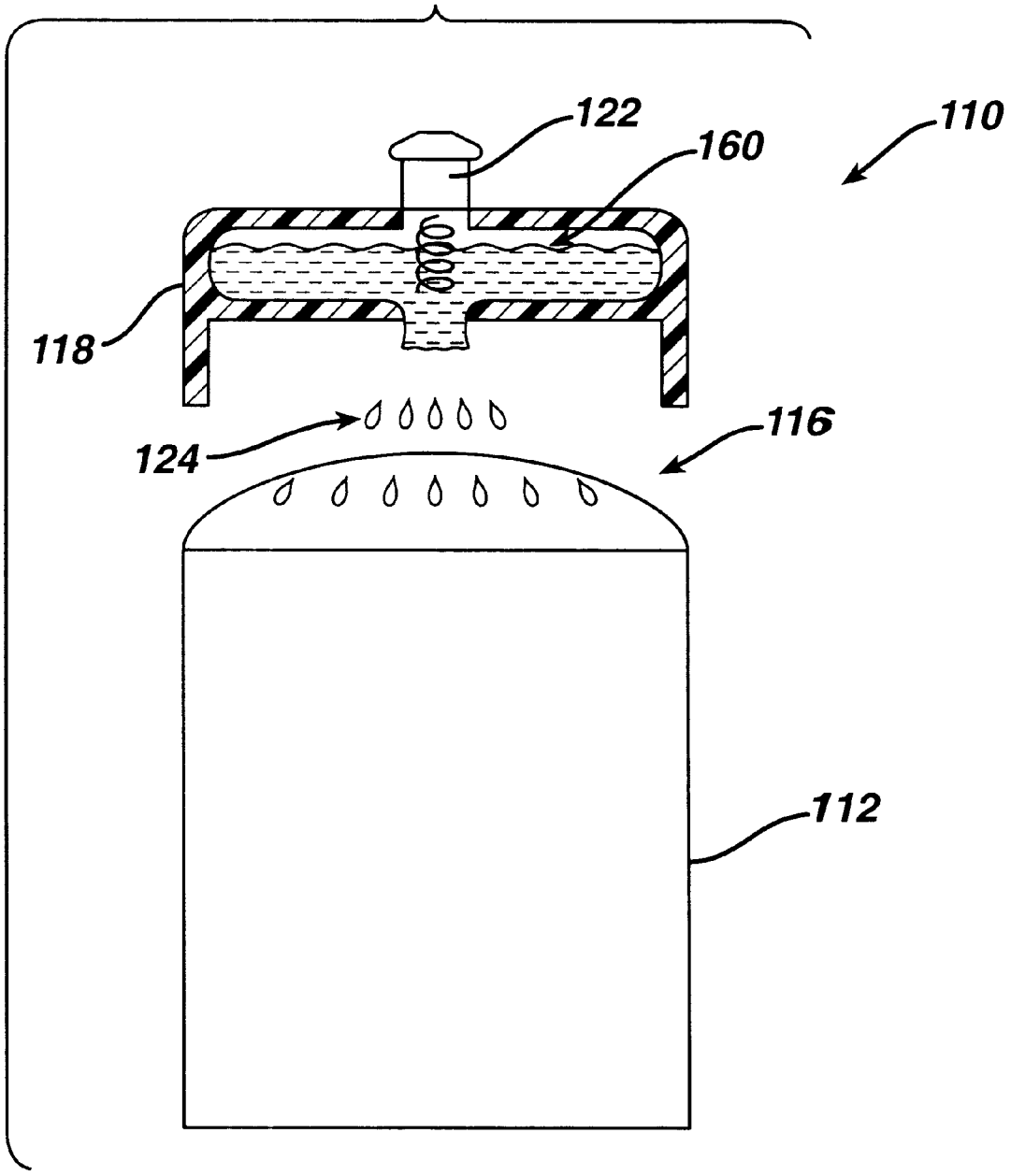
FIG. 6 is a schematic perspective view of a dispensing system according to an alternate embodiment of the invention in which a liquid is dispensed from the cap.

As shown in FIG. 6, a dispensing system 110 can be used to dispense a liquid 124 from a cap 118 onto the dispensing end 116 of a dispenser body 112 when an actuator 122 is depressed or turned. In this embodiment, cap 118 includes a liquid dispensing device 160 that is constructed to deliver droplets of liquid, e.g., by atomization as will be discussed below.

Figure 7:
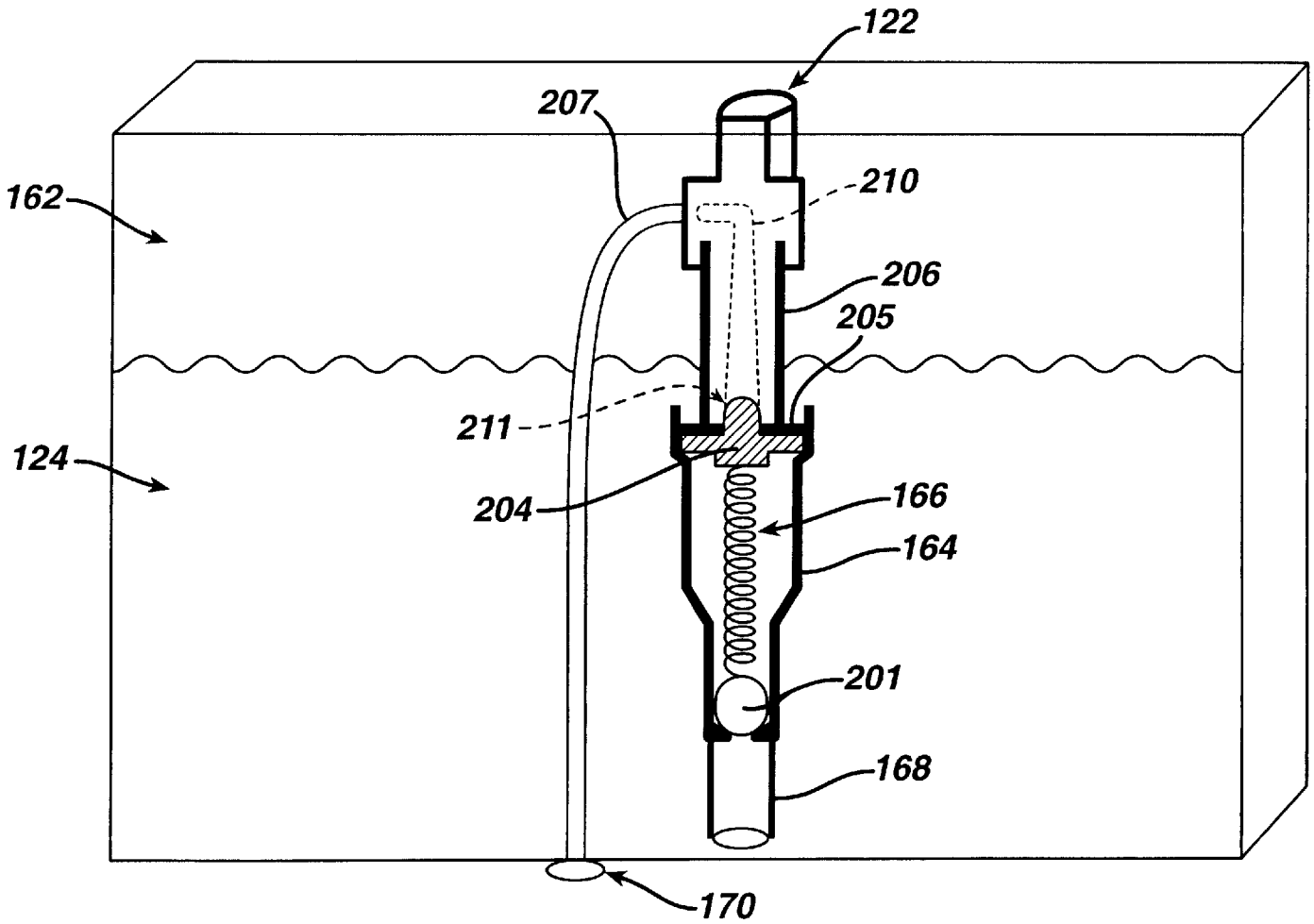
FIG. 7 is a cross-sectional view of a cap suitable for use in the dispensing system of FIG. 6.

As shown in FIG. 7, in one embodiment the liquid dispensing device includes a liquid reservoir 162 containing a supply of liquid 124, and a pump spray device, e.g., a spray pump system commercially available from Seaquist Perfect Dispensing (www.seagperf.com) that has been modified so that the liquid 124 exits from the bottom of the cap. Briefly, the pump spray device includes a hollow shaft 164 and a piston 206 that are connected to an actuator 122 and biased to a normal position (FIG. 7) by spring 166. An intake tube 168 extends from the lower end of hollow shaft 164, and is normally sealed off from the shaft 164 by a ball 201. Within the piston 206 is a tube 210, which is in fluid communication with an outlet tube 207, which in turn communicates with a spray orifice 170. A gasket 204 seals the lower end of tube 210 when the pump spray device is in its normal position. After the pump spray system has been initially primed by depressing the actuator several times (when the dispensing system is used for the first time), the hollow shaft 164 will normally be full of liquid. Upon depressing the actuator 122, piston 206 presses down on piston base 205, causing spring 166 to be compressed. The pressure on piston base 205 breaks the seal between the gasket 204 and end of tube 210, allowing fluid to flow from the hollow shaft 164 into tube 210, and from tube 210 into outlet tube 207 and thus to spray orifice 170. When the actuator is released and the spring relaxes, ball 201 moves upward allowing liquid to flow upward through intake tube 168 into the hollow shaft 164, refilling the hollow shaft 164.

Figure 8:
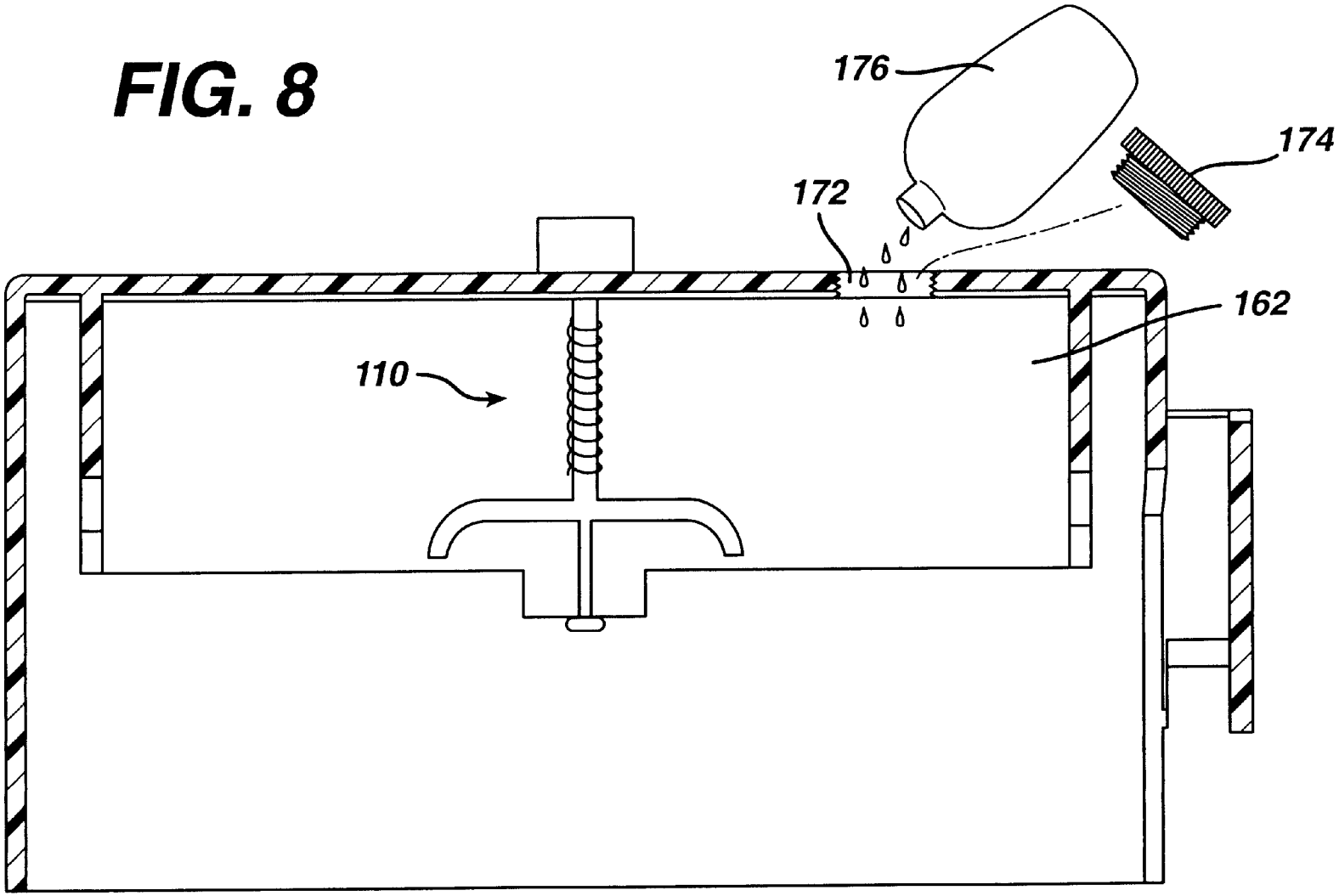
FIG. 8 is a cross-sectional view of an alternative cap suitable for use in the dispensing system of FIG. 6, with the dispensing mechanism shown schematically.

As shown in FIG. 8, the liquid reservoir 162 may be empty when the dispensing system 110 is supplied to the user, and may include an inlet 172 having a removable cover 174. Thus, the user may remove the cover 174 and charge the reservoir, e.g., with the user's own perfume 176, as shown. (Similarly, if the cap is designed to dispense a powder, the user could fill the powder reservoir with a desired powdered substance, e.g., perfumed talcum powder.) The reservoir 162 may also be pre-filled with a supply of a carrier powder (not shown), to which the user adds a supply of a liquid, e.g., the user's own perfume, which is absorbed by the carrier powder. To facilitate charging the reservoir with liquid, the cover 174 may be replaced by a one-way valve if desired.

Figure 9:
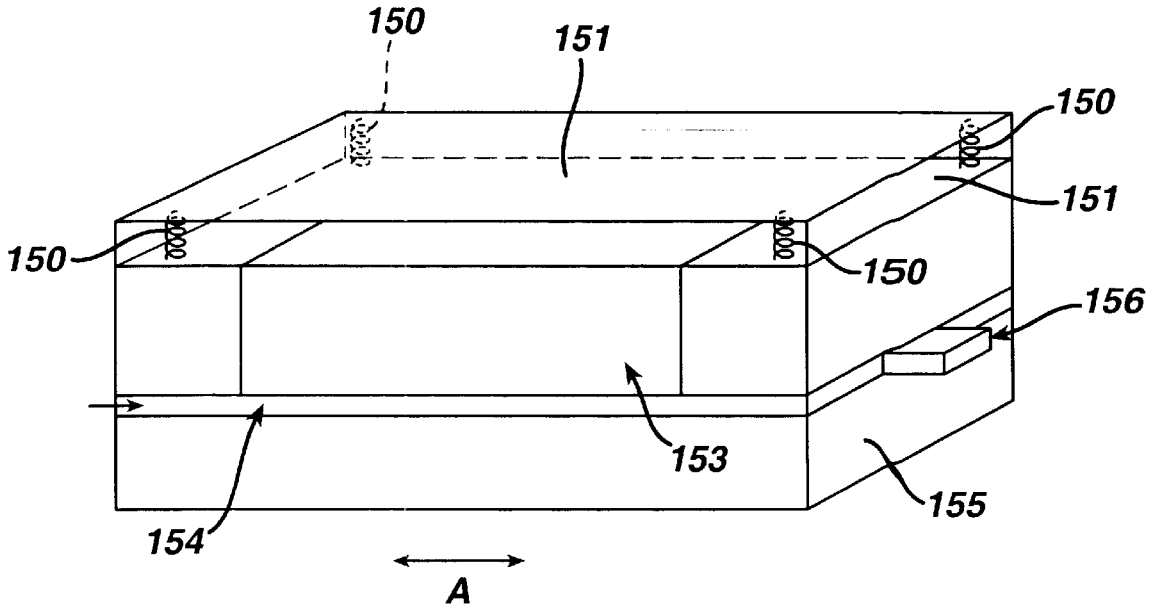
FIG. 9 is a cut-away perspective view of a cap suitable for dispensing a compressed powder.
Figure 9A:
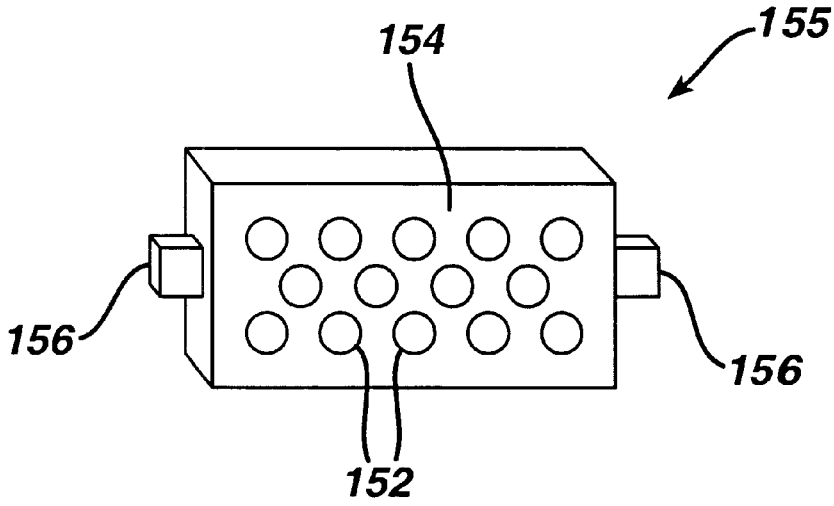
FIG. 9A is a top view of a grating plate used in the cap of FIG. 9.
Figure 9B:
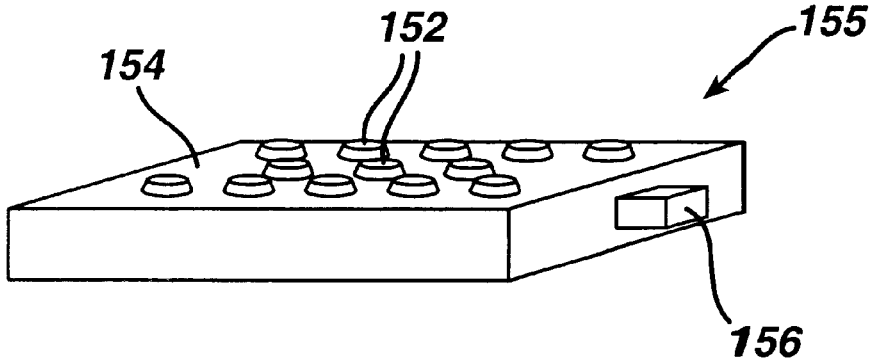
FIG. 9B is a perspective view of the grating plate.

Alternatively, the substance in the cap may be provided in the form of a compressed powder. In this case, the cap may include a dispensing mechanism as shown in FIG. 9. In this embodiment, a block 153 of compressed powder is placed in a chamber that is defined by a top plate 151 and a bottom plate 155 that includes a cutting surface 154 that is positioned against the lower surface of the block 153. The bottom plate 155 is shown in detail in FIGS. 9A and 9B. The cutting surface 154 includes a plurality of grating apertures 152 that have sharp edges that protrude above the cutting surface, as shown in FIG. 9B. A pair of actuators 156, positioned on the sides of the plate 155, allow the plate 155 to be pushed back and forward (arrow A, FIG. 9), causing the cutting surface 154 to abrade the lower surface of block 153. The powder that is removed by the grating action of cutting surface 154 drops through grating apertures 152 (which extend through the thickness of plate 155) and is thus dispensed from the cap. Top plate 151 is spring-loaded by springs 150, so that as powder is removed the block 153 remains pressed firmly against the cutting surface 154.

Many substances may be dispensed from the cap. Suitable substances include glide enhancers, e.g., micronized beads and boron nitride; exfoliants, e.g., abrasive particles, loofa, polyethylene beads, jojoba oil microspheres and nylon; wetness, greasiness and oiliness reducing ingredients, e.g., starches, water lock agents, polypore, microsponge, silicone elastomers and absorbents; anti-caking agents, e.g., calcium phosphate, silicas, aluminosilicates and emollients; and ingredients that provide a sensation of coolness, e.g., menthol, menthyl lactate, and sodium palmitoyl proline.

Other suitable substances include adhesion agents, fragrances, deodorant actives (e.g., ACH, Farnesol and octoxyglycerine), aluminum salts, talcs, efficacy enhancing agents (e.g., calcium chloride, for antiperspirants), odor modifiers (e.g., sodium bicarbonate), anti-irritants (e.g., allantoin), detackifiers (e.g., silicones, emollient esters and oils), water or encapsulated water, and anti-stain agents (e.g., Vitamin E and tocopherols). Many other examples of suitable materials are listed below. However, these are only examples and many others may be used, as will be apparent to those of skill in the art.

If aluminum salts are used, it may be necessary to restrict the level of aluminum salt in the composition to be delivered from the cap if the product is for sale in the United States. This is because aluminum salts are monographed by the FDA, and the FDA monograph requires that "no more than 25% by weight of a formula may be composed of an AP salt." As a result, if it is necessary to comply with this FDA requirement then a filler powder should be added to the aluminum salt so that the amount of aluminum salt in the composition delivered by the cap is 25% or less. Suitable fillers for this purpose would include co-salts and talc powders, which would advantageously also increase glide and efficacy.

Other embodiments are within the claims.

For example, while the discussion above focuses primarily on antiperspirant and deodorant products, the dispensing system can be used to dispense a wide variety of products, including, e.g., toothpastes, sun screens, shaving preparations, aftershaves, condiments, soaps (e.g., bars, powders and gels), candies (e.g., powders, liquids, gels and sticks), fabric softeners, laundry soaps (e.g., powders, liquids and gels), cosmetics (e.g., lipstick, blush, mascara), medications (e.g., for diaper rash, anti-itch, eczema, anti-sting and wound repair), paints, pet powders (e.g., flea, tick and deodorant treatments), shoe polishes, floor cleaners, tub and tile cleaner, hair color treatments, window cleaners, and polishes and waxes.

In addition, the cap can be used to dispense a wide variety of different materials, examples of which are listed below:

Emollients/Antiwhitening Agents

Acetyl Trioctyl Citrate, Apricot Kernel Oil PEG-6 Esters, Arachidyl Propionate, Avocado Oil, Bay Oil, Behenyl Erucate, Bisphenylhexamethicone, Butyl Acetyl Ricinoleate, Butyl Myristate, Butyl Oleate, Butyl Stearate, C18–36 Acid Glycol Ester, C12–15 Alcohols Benzoate, C12–15 Alcohols Lactate, C12–15 Alcohols Octanoate, C14–15 Alcohols, C15–18 Glycol, C18–20 Glycol Isostearate, C14–16 Glycol Palmitate, C13–14 Isoparaffin, C13–16 Isoparaffin, C20–40 Isoparaffin, C11–15 Pareth-3 Oleate, C11–15 Pareth-3 Stearate, C11–15 Pareth-12 Stearate, C12–15 Pareth-9 Hydrogenated Tallowate, C12–15 Pareth-12 Oleate, C30–46 Piscine Oil, Caprylic/Capric/Diglyceryl Succinate, Caprylic/Capric Glycerides, Caprylic/Capric/Isostearic/Adipic Triglycerides, Cetearyl Alcohol, Cetearyl Isononanoate, Cetearyl Palmitate, Cetyl Acetate, Cetyl Alcohol, Cetylarachidol, Cetyl Esters, Cetyl Lactate, Cetyl Myristate, Cetyl Octanoate, Cetyl Palmitate, Cetyl Ricinoleate, Cetyl Stearate, CocoCaprylate/Caprate, Cocoglycerides, Coconut Alcohol, Corn Oil PEG-6 Esters, Cottonseed Glyceride Cottonseed Oil Cyclomethicone, Decyl Alcohol, Decyl Isostearate, Decyl Oleate, Decyl Succinate, Decyltetradecanol, Dibutyl Adipate, Dibutyl Sebacate, Di-C12–15 Alcohols Adipate, Dicapryl Adipate, Dicetyl Adipate, Diethylene Glycol Dibenzoate, Diethyl Palmitoyl Aspartate, Diethyl Sebacate, Dihexyl Adipate, Dihydrocholesteryl Octyldecanoate, Dihydrophytosteryl Octyldecanoate, Dihydroxyethyl Soyamine Dioleate, Dihydroxyethyl Tallowamine Oleate, Diisobutyl Adipate, Diisocetyl Adipate Diisodecyl Adipate, Diisopropyl Adipate, Diisopropyl Dilinoleate, Diisopropyl Sebacate, Diisostearyl Adipate, Diisostearyl Dilinoleate, Diisostearylmalate, Dilauryl Citrate, Dimethicone Copolyol, Dimethiconol, Dioctyl Adipate, Dioctyl Dilinoleate, Dioctyl Sebacate, Dioctyl Succinate, Dipropylene Glycol Dibenzoate, Ditridecyl Adipate, Dodecyltetradecanol, Ethyl Arachidonate, Ethyl Laurate, Ethyl Linoleate, Ethyl Linoleanate, Ethyl Morrhuate, Ethyl Myristate, Ethyl Palmitate, Ethyl Pelargonate, Ethyl Persate, Ethyl Stearate, Fish Glycerides, Glyceryl Behenate, Glyceryl Caprate, Glyceryl Caprylate, Glyceryl Caprylate, Glyceryl Caprylate/Caprate, Glyceryl Cocoate, Glyceryl Dilaurate, Glyceryl Dioleate, Glyceryl Distearate, Glyceryl Erucate, Glyceryl Hydroxystearate, Glyceryl Isostearate Glyceryl Lanolate, Glyceryl Laurate, Glyceryl Linoleate, Glyceryl Myristate, Glyceryl Oleate, Glyceryl Palmitate Lactate, Glyceryl Ricinoleate, Glyceryl Sesquioleate, Glyceryl Stearate, Glyceryl Stearate Citrate, Glyceryl Stearate Lactate, Glyceryl Triacetyl Hydroxystearate, Glyceryl Triacetyl Ricinoleate, Glyceryl Trioctanoate, Glyceryl Triundecanoate, Glycol Dioctanoate, Glycol Hydroxystearate, Glycol Oleate, Glycol Ricinoleate, Glycol Stearate, Heptylundecanol, Hexyl Laurate, Hydrogenated Coco-Glycerides, Hydrogenated Lard Glyceride, Hydrogenated Lard Glycerides, Hydrogenated Palm Glycerides, Hydrogenated Palm Kernel Glycerides, Hydrogenated Palm Oil Glyceride, Hydrogenated Palm Oil Glycerides, Hydrogenated Palm/Palm Kernel Oil PEG-6 Esters, Hydrogenated Polyisobutene, Hydrogenated Soybean Oil Glycerides, Hydrogenated Soy Glyceride, Hydrogenated Tallow Glyceride, Hydrogenated Tallow Glyceride Citrate, Hydrogenated Tallow Glyceride Lactate, Hydrogenated Tallow Glycerides, Hydrogenated Tallow Glycerides Citrate, Hydrogenated Vegetable Glyceride, Hydrogenated Vegetable Glycerides, Hydrogenated Vegetable Glycerides Phosphate, Hydroxylated Lanolin, Hydroxyoctaconsanyl Hydroxystearate, Isoamyl Laurate, Isobutyl Myristate, Isobutyl Palmitate, Isobuytl Pelargonate, Isobutyl Stearate, Isocetyl Alcohol, Isocetyl Isodecanoate, Isocetyl Palmitate, Isocetyl Stearate, Isocetyl Stearoyl Stearate, Isodecyl Hydroxystearate, Isodecyl Isononanoate, Isodecyl Laurate, Isodecyl Myristate, Isodecyl Neopontanoate, Isodecyl Oleate, Isodecyl Palmitate, Isononyl Isononanoate, Isopropyl Isostearate, Isopropyl Lanolate, Isopropyl Laurate, Isopropyl Linoleate, Isopropyl Methoxycinnamate, Isopropyl Myristate, Isopropyl Oleate, Isopropyl Palmitate, Isopropyl Ricinoleate, Isopropyl Stearate, Isopropyl Tallowate, Isostearyl Alcohol, Isostearyl Benzoate, Isostearyl Isostearate, Isostearyl Lactate, Isostearyl Neopentanoate, Isostearyl Palmitate Isotridecyl Isononanoate, Laneth-9 Acetate, Laneth-10 Acetate, Lanolin, Lanolin Alcohol, Lanolin Oil, Lanolin Wax, Lard Glycerides, Laureth-2 Benzoate, Lauryl Alcohol, Lauryl Glycol, Lauryl Isostearate, Lauryl Lactate, Lauryl Myristate, Lauryl Palmitate, Methyl Acetyl Ricinoleate, Methyl Caproate, Methyl Caprylate, Methyl Caprylate/Caprate, Methyl Cocoate, Methyl Dehydroabietate, Methyl Glucose Sesquioleate, Methyl Glucose Sesquistearate, Methyl Hydrogenated Rosinate, Methyl Hydroxystearate, Methyl Laurate, Methyl Linoleate, Methyl Myristate, Methyl Oleate, Methyl Palmitiate, Methyl Pelargonate, Methyl Ricinoleate, Methyl Rosinate, Methyl Stearate, Mineral Oil, Mink Oil, Myreth-3 Caprate, Myreth-3 Laurate, Myreth-3 Myristate, Myreth-3 Palmitate, Myristyl Alcohol, Myristyleiconsanol, Myristyleicosyl Stearate, Myristyl Isostearate, Myristyl Lactate, Myristyl Lignocerate, Myristyl Myristate, Myristyl Neopentanoate, Myristyloctandecanol, Myristyl Propionate, Myristyl Stearate, Neopentyl Glycol Dicaprate, Neopentyl Glycol Dioctanoate, Nonyl Acetate, Octyl Acetoxystearate, Octyldodecanol, Octyldodecyl Neodecanoate, Octyl Hydroxystearate, Octyl Isononanoate, Octyl Myristate, Octyl Palmitate, Octyl Pelargonate, Octyl Stearate, Oleyl Acetate, Oleyl Alcohol, Oleyl Arachidate, Oleyl Erucate, Oleyl Lanolate, Oleyl Myristate, Oleyl Oleate, Oleyl Stearate, Palm Kernel Alcohol, Palm Kernel Glycerides, Palm Oil Glycerides, PEG-6 Caprylic/Capric Glycerides, PEG-2 Castor Oil, PEG-3 Castor Oil, PEG-4 Castor Oil, PEG-5 Castor Oil, PEG-8 Castor Oil, PEG-9 Castor Oil, PEG-10 Castor Oil, PEG-10 Coconut Oil Esters, PEG-5 Glyceryl Triisostearate, PEG-5 Hydrogenated Castor Oil, PEG-7 Hydrogenated Castor Oil, PEG-5 Hydrogenated Corn Glycerides, PEG-8 Hydrogenated Fish Glycerides, PEG-20 Methyl Glucose Sesquistearate, Pentaerythritol Rosinate, Pentaerythrityl Tetraoctanoate, Pentaerythrityl Tetraoleate, PPG-4-Ceteth-1, PPG-8-Ceteth-1, PPG-8-Ceteth-2, PPG-10 Cetyl Ether, PPG-10 Cetyl Ether Phosphates, PPG-28 Cetyl Ether, PPG-30 Cetyl Ether, PPG-50 Cetyl Ether, PPG-17 Dioleate, PPG-3 Hydrogenated Castor Oil, PPG-30 Isocetyl Ether, PPG-5 Lanolate, PPG-2

Lanolin Alcohol Ether, PPG-5 Lanolin Alcohol Ether, PPG-10 Lanolin Alcohol Ether, PPG-20 Lanolin Alcohol Ether, PPG-30 Lanolin Alcohol Ether, PPG-5 Lanolin Wax, PPG-5 Lanolin Wax Glyceride, PPG-9 Laurate, PPG-4 Lauryl Ether, PPG-3 Myristyl Ether, PPG-4 Myristyl Ether, PPG-26 Oleate, PPG-36 Oleate, PPG-10 Oleyl Ether, PPG-20 Oleyl Ether, PPG-23 Oleyl Ether, PPG-30 Oleyl Ether, PPG-37 Oleyl Ether, PPG-50 Oleyl Ether, PPG-9-Steareth-3, PPG-11 Stearyl Ether, PPG-15 Stearyl Ether, Propylene Glycol Isostearate, Propylene Glycol Hydroxystearate, Propylene Glycol Laurate, Propylene Glycol Myristate, Propylene Glycol Myristyl Ether, Propylene Glycol Myristyl Ether Acetate, Propylene Glycol Oleate, Propylene Glycol Ricinoleate, Propylene Glycol Soyate, Propylene Glycol Stearate, Silica Silylate, Soybean Oil Unsaponifiables, Soy Sterol, Soy Sterol Acetate, Squalene, Stearoxytrimethylsilane, Stearyl Acetate, Stearyl Alcohol, Stearyl Citrate, Stearyl Lactate, Sucrose Distearate, Sulfurized Jojoba Oil, Sunflower Seed Oil Glycerides, Tall Oil Glycerides, Tallow Glyceride, Tallow Glycerides, Tridecyl Alcohol, Triisocetyl Citrate, Triisostearin PEG-6 Esters, Trimethylsilylamodimethicone, Triolein PEG-6 Esters, Tris (Tributoxysiloxy)Methylsilane, Undecylpentadecanol, Vegetable Glycerides Phosphate, Wheat Germ Glycerides Humectants Acetamide MEA, Fructose, Glucamine, Glucose, Glucose Glutamate, Glucuronic Acid, Glutamic Acid, Glycereth-7, Glycereth-12, Glycereth-26, Glycerin, Histidine, Honey, Hydrogenated Honey, Hydrogenated Starch Hydrolysate, Lactose, Maltitol, Mannitol, Methyl Gluceth-10, Methyl Gluceth-20, PCA, PEG-10 Propylene Glycol, Polyamino Sugar Condensate, Propylene Glycol, Pyrisoxine Dilaurate, Saccharide Hydrolysate, Saccharide Isomerate, Sodium Lactate, Sodium PCA, Sorbitol Sucrose, TEA-Lactate, TEA-PCA, Urea, Xylitol Corn Syrup, Fructose, Glucose, Glycerin, Glycol, 1,2,6-Hexanetriol, Inositol, Lactic Acid, PEG-4, PEG-6, PEG-8, PEG-9, PEG-10, PEG-12, PEG-14, PEG-16, PEG-18, PEG-20, PEG-32, PEG-40, PEG-75, PEG-135, PEG-150, PEG-200, PEG-5 Pentaerythritol Ether, Polyglyceryl Sorbitol, Propylene Glycol, Sodium PCA, Sorbitol, Sucrose, Urea, Xylitol Film Formers Acrylamide Copolymers, Acrylamide/Sodium Acrylate Copolymers, Acrylate/Acrylamide Copolymers, Acrylate/Ammonium Methacrylate Copolymers, Acrylate Copolymers, Acrylates/Diacetoneacrylamide Copolymer, Acrylic/Acrylate Copolymer, Adipic Acid/Dimethylaminohydroxypropyl Diethylenetriamine Copolymer, Adipic Acid/Epoxypropyl Diethylenetriamine Copolymer, Albumen, Allyl Stearate/VA Copolymer, Aminoethylactylate Phosphate/Acrylate Copolymer, Ammonium Acrylates Copolymer, Ammonium Alginate, Ammonium Vinyl Acetate/Acrylates Copolymer, AMP Acrylates/Diacetoneacrylamide Copolymer, AMPD Acrylates/Diacetoneacrylamide Copolymer, Balsam Canada, Balsam Oregon, Balsam Peru, Balsam Tolu, Benzoic Acid/Plithalic Anhydride/Pentaelythritol/Neopentyl Glycol/Palmitic Acid Copolymer, Benzoin Extract, Butadiene/Acrylonitrile Copolymer, Butylate Urea-Formaldehyde Resin, Butyl Benzoic Acid/Phthalic Anhydride/Trimethylolethane Copolymer, Butyl Ester of Ethylene/Maleic Anhydride Copolymer, Butyl Ester of PVM/MA Copolymer, Calcium Carrageenan, Calcium/Sodium PVM/MA Copolymer Carboxymethyl Hydroxyethylcellulose, Cellulose Gum, Collodion, Copal, Corn Starch/Acrylamide/Sodium Acrylate Copolymer, Damar, Diethylene Glycolamine/Epichlorohydrin/Piperazine Copolymer, DMHF, Dodecanedioic Acid/Cetearyl Alcohol/Glycol Copolymer, Ethylcellulose, Ethylene/Acrylate Copolymer, Ethylene/Maleic Anhydride Copolymer, Ethylene/Vinyl Acetate Copolymer, Ethyl Ester of PVM/MA Copolymer, Flexible Collodion, Gum Benzoin, Gutta Percha, Hydroxybutyl Methylcellulose, Hydroxyethylcellulose, Hydroxyethyl Ethylcellulose, Hydroxypropylcellulose, Hydroxypropyl Guar, Hydroxypropyl Methylcellulose, Isopropyl Ester of PVM/MA Copolymer, Maltodextrin, Melamine/Formaldehyde Resin, Methacryloyl Ethyl Betaine/Methacrylate Copolymer, Nitrocellulose, Octylacrylamide/Acrylate/Butylaminoethyl Methacrylate Copolymer, Octylacrylamide/Acrylates Copolymer, Phthalic Anhydride/Glycerin/Glycidyl Decanoate Copolymer, Phthalic/Trimellitic/Glycols Copolymer, Polyacrylamide, Polyacrylamidomethylpropane Sulfonic Acid, Polyacrylic Acid, Polybutylene Terephthalate, Polychlorotrifluoroethylene, Polyethylacrylate, Polyethylene, Polyethylene Terephthalate, Polyisobutene, Polyquaternium-1, Polyquatemium-2, Polyquaternium-4, Polyquaternium-5, Polyquaternium-6, Polyquaternium-7, Polyquaternium-8, Polyquaternium-9, Polyquaternium-10, Polyquaternium-11, Polyquatemium-12, Polyquatemium-13, Polyquatemium-14, Polyquaternium-15, Polystyrene, Polyvinyl Acetate, Polyvinyl Alcohol, Polyvinyl Butyral, Polyvinyl Imidazolinium Acetate, Polyvinyl Laurate, Polyvinyl Methyl Ether, Potassium Carrageenan, PVM/MA Copolymer, PVP, PVP/Dimethylaminoethylmethacrylate Copolymer, PVP/Eicosene Copolymer, PVP/Ethyl Methacrylate/Methacrylic Acid Copolymer, PVP/Hexadecene Copolymer, PVP/VA Copolymer PVP/Vinyl Acetate/Itaconic Acid Copolymer Rosin, Serum Albumin, Shellac, Sodium Acrylate/Vinyl Alcohol Copolymer, Sodium Carrageenan, Sodium Polymethacrylate, Sodium Polystyrene Sulfonate, Starch/Acrylate/Acrylamide Copolymer, Starch Diethylaminoethyl Ether, Stearylvinyl Ether/Maleic Anhydride Copolymer, Styrene/Acrylate/Acrylonitrile Copolymer, Styrene/Acrylate/Ammonium Methacrylate Copolymer, Styrene/Maleic Anhydride Copolymer, Styrene/PVP Copolymer, Sucrose Benzoate/Sucrose Acetate Isobutyrate/Butyl Benzyl Phthalate Copolymer, Sucrose Benzoate/Sucrose Acetate Isobutyrate/Butyl Benzyl Phthalate/Methyl Methacrylate Copolymer, Sucrose Benzoate/Sucrose Acetate Isobutyrate Copolymer, Toluenesulfonamide/Formaldehyde Resin, Tragacanth Gum, Vinyl Acetate/Crotonates Copolymer, Vinyl acetate/Crotonic Acid Copolymer, Vinyl Acetate/Crotonic Acid/Methacryloxybenzophenone-1 Copolymer, Vinyl Acetate/Crotonic Acid/Vinyl Neodecanoate Copolymer, Zein Occlusive Film Formers Acetylated Castor Oil, Acetylated Glycol Stearate, Acetylated Hydrogenated Cottonseed Glyceride, Acetylated Hydrogenated Lard Glyceride, Acetylated Hydrogenated Tallow Glyceride, Acetylated Hydrogenated Vegetable Glyceride, Acetylated Lanolin, Acetylated Lanolin Alcohol, Acetylated Lanolin Ricinoleate, Acetylated Lard Glyceride, Acetylated Palm Kernel Glycerides, Acetylated Sucrose Distearate, Aluminum Isostearates/Laurates/Palmitates, Aluminum Isostearates/Laurates/Stearates, Aluminum Isostearates/Myristates, Aluminum Isostearates/Palmitates, Aluminum Isostearates/Stearates, Aluminum Lanolate, Aluminum Myristates/Palmitates, Aluminum Stearate, Aluminum Stearates, Aluminum Tristearate, Apricot Kernel Oil, Avocado Oil, Avocado Oil Unsaponifiables, Batyl Alcohol, Batyl Isostearate, Batyl Stearate, Bayberry Wax, Biphenylhexamethicone, Butter C18–36 Acid Triglyceride, C30–46 Piscine Oil, C10–18 Triglycerides, Caprylic/Capric/Isostearic/Adipic Triglycerides, Caprylic/Capric/Lauric Triglyceride, Caprylic/Capric/Linoleic Triglyceride, Caprylic/Capric/Stearic Triglyceride, Caprylic/Capric Triglyceride, Castor Oil, Chaulmoogra Oil, Cherry Pit Oil, Cocoa Butter, Coconut Oil, Cod Liver Oil, Corn Oil, Cottonseed Oil, Dihydrogenated Tallow Phthalate, Diisostearyl Silinoleate, Dilinoleic Acid, Dimethicone, Dioctyl Dilinoleate, Ditridecyl Dilinoleate, Egg Oil, Erucyl Arachidate, Erucyl Erucate, Ethiodized Oil, Glyceryl Tribehenate, Glycol Dibehenate, Grape Seed Oil, Hazel Nut Oil, Hexadecyl Methicone, Hexanediol Distearate, Hybrid Safflower Oil, Hydrogenated C6–14 Olefin Polymers, Hydrogenated Castor Oil, Hydrogenated Coconut Oil, Hydrogenated Cottonseed Oil, Hydrogenated Jojoba Oil, Hydrogenated Jojoba Wax, Hydrogenated Lanolin, Hydrogenated Lard, Hydrogenated Menliaden Oil, Hydrogenated Palm Kernel Oil, Hydrogenated Palm Oil, Hydrogenated Peanut Oil, Hydrogenated Rice Bran Wax, Hydrogenated Shark Liver Oil, Hydrogenated Soybean Oil, Hydrogenated Tallow, Hydrogenated Vegetable Oil, Isobutylated Lanolin Oil, Isostearyl Erucate, Isostearyl Stearoyl Stearate, Jojoba Butter, Jojoba Oil, JojobaWax, Lanolin Linoleate, Lanolin Ricinoleate, Lard, Lauryl Stearate, Linseed Oil, Menhaden Oil, Methicone, Mineral Oil, Mink Oil, Mink Wax, Moringa Oil, Neatsfoot Oil, Octyldodecyl Myristate, Octyldodecyl Stearate, Octyldodecyl Stearoyl Stearate, Oleostearin, Oleyl Lanolate, Oleyl Linoleate, Olive Husk Oil, Olive Oil, Olive Oil Unsaponifiables, Palm Kernel Oil, Palm Oil, Paraffin, Peach Kernel Oil, Peanut Oil, Pengawar Djambi Oil, Pentdesma Butter, Pentaeiythrityl Hydrogenated Rosinate, Pentaerythrityl Tetraabietate, Pentaerythrityl Tetrabehenate, Pentaerythrityl Tetrastearate, Pentahydrosqualene, Petrolatum, Phenyl Trimethicone, Pristane, Propylene Glycol Dicaprylate, Propylene Glycol Dicaprylate/Dicaprate, Propylene Glycol Dicocoate, Propylene Glycol Dilaurate, Propylene Glycol Dioctanoate, Propylene Glycol Pipelargonate, Propylene Glycol Distearate, Propylene Glycol Diundecanoate, Rapeseed Oil, Rapeseed Oil Unsaponifiables, Rice Bran Oil, Rice Bran Wax, Safflower Oil, Sesame Oil, Shark Liver Oil, Shea Butter, Shea Butter Unsaponifiables, Shellac Wax, Soybean Oil, Soybean Oil Unsaponifiables, Soy Sterol Acetate, Squalane, Stearoxy Dimethicone, Stearyl Caprylate, Stearyl Caprylate/Caprate, Stearyl Eurcate, Stearyl Heptanoate, Stearyl Octanoate, Stearyl Stearate, Stearyl Stearoyl Stearate, Sunflower Seed Oil, Sweet Almond Oil, Synthetic Jojoba Oil, Synthetic Wax, Tall Oil, Tallow, Tallow Glycerides, Tricaprin, Trihydroystearin, Trisononanoin, Triisopropyl Trilinoleate, Triisostearin, Triisonstearyl Trilinoleate, Trilaurin, Trilauryl Citrate, Trilinoleic Acid, Trilinolein, Trimethylolpropane, Triisostearate, Trimethylolpropane, Trioctanoate, Trimethyl siloxysilicate, Trimyristin, Trioctyl Citrate, Triolein, Trioleyl Phosphate, Tripalmitin, Tristearin, Tristearyl Citrate, Vegetable Oil, Walnut Oil, Wheat Bran Lipids, Wheat Germ Oil Glide-Enhancing Agents Micronized beads, polytetrafluoroethylene (PTFE), glass, polyethylene, silicone elastomers (9506 Dow Corning), Dry-Flo PC (National Starch and Chemical)

Exfoliants

Almond Meal, Alumina, Aluminum Silicate, Barley Flour, Calcium Carbonate, Calcium Phosphate, Calcium Pyrophosphate, Calcium Sulfate, Chalk, Corn Cob Meal, Corn Flour, Corn Meal, Corn Starch, Diatomaceous Earth, Dicalcium Phosphate, Dicalcium Phosphate Dihydrate, Fullers Earth, Hydrated Silica, Magnesium Trisilicate, Oat Bran, Oat Flour, Oatmeal, Peanut Flour, Pecan Shell Powder, Pumice, Rice Bran, Rye Flour, Silica, Sodium Silicoaluminate, Soy Flour, Tricalcium Phosphate, Walnut Shell Powder, Wheat Bran, Wheat Flour, Wheat Starch, Zirconium Silicate Absorbents Natrasorb absorbent (American Starch), polyacrylamide, hydrogels, polyvinyl acetate, poly aspartate, polyethylene, Methocel absorbent (Dow Chemical) Aluminum Silicate, Aluminum Starch Octenylsuccinate, Bentonite, Calamine, Calcium Silicate, Cellulose, Chalk, Corn Starch, Cotton, Dextrin, Diatomaceous Earth, Fullers Earth, Glyceryl Starch, Hectorite, Hydrated Silica, Kaolin, Magnesium Aluminum Silicate, Magnesium Carbonate, Magnesium Hydroxide, Magnesium Oxide, Magnesium Silicate, Magnesium Trisilicate, Maltodextrin, Microcrystalline Cellulose, Montmorillonite, Oat Bran, Oat Flour, Oatmeal, Potassium Aluminum Polyacrylate, Potato Starch, Silica, Talc, Wheat Starch Anticaling Agents Alumina, Aluminum Behenate, Aluminum Caprylate, Aluminum Dilinoleate, Aluminum Distearate, Aluminum Isostearates/Laurates/Palmitates, Aluminum Isostearates/Laurates/Stearates, Aluminum Isostearates/Myristates, Aluminum Isostearates/Palmitates, Aluminum Isostearates/Stearates, Aluminum Lanolate, Aluminum Myristates/Palmitates, Aluminum Silicate, Aluminum Starch Octenylsuccinate, Aluminum Stearate, Aluminum Stearates, Aluminum Tristearates, Ammonium Xylenesulfonate, Calcium Behenate, Calcium Stearate, Distarch Phosphate, Lithium Stearate, Magnesium Aluminum Silicate, Magnesium Cocoate, Magnesium Lanolate, Magnesium Myristate, Magnesium Palmitate, Magnesium Silicate, Magnesium Stearate, Magnesium Tallowate, Magnesium Trisilicate, Microcrystalline Cellulose, Silica, Talc, Zinc Laurate, Zinc Myristate, Zinc Neodecanoate, Zinc Rosinate, Zinc Stearate Biological Extracts Acerola, Agrimony Extract, Alfalfa Extract, Algae Extract, Aloe, Aloe Extract, Aloe Vera Gel, Althea Extract, Amniotic Fluid, Amylase, Angelica Extract, Animal Tissue Extract, Anise Extract, Apple Extract, Apricot Extract, Arbutus Extract, Arnica Extract, Artichoke Extract, Asafoetida Extract, Asparagus Extract, Avens Extract, Avocado Extract, Azulene, Balm Mint Extract, Banana Extract, Basil Extract, Bearberry Extract, Benzoin Extract, Berberis Extract, Bilberry Extract, Bioflavinoids, Biotin, Birch Bark Extract, Birch Extract, Birch Leaf Extract, Birch Sap, Bisbolol, Bisstort Extract, Bitter Almond Extract, Blackberry Extract, Black Currant Extract, Black Mustard Extract, Black Walnut Extract, Bladderwrack Extract, Blessed Thistle Extract, Blue Cohosh, Borage Extract, Brain Extract, Broom Extract, Buckbean Extract, Buckthorn Extract, Buckwheat Extract, Bugloss Extract, Burdock Root Extract, Butcherbroom Extract, Cabbage Extract, Cabbage Rose Extract, Cabbage Root Extract, Calendula Extract, Calfskin Extract, Capsicum Extract, Capsicum Oleoresin, Carob Extract, Carrot Extract, Carrot Juice, Carrot Oil, Carrot Seed Extract, Celandine Extract, Chamomile Extract, Chapparel Extract, Chaulmoogra Oil, Chicory Extract, Chinese Tea Extract, Cholecalciferol, Cinchona Extract, Clematis Extract, Clover Blossom Extract, Cocoa Extract, Colocynth Extract, Coltsfoot Extract, Coltsfoot Leaf Extract, Comfrey Extract, Comfrey Leaf Extract, Condurango Extract, Coneflower Extract, Corn Germ Extract, Corn Poppy Extract, Corn Silk Extract, Couch Grass Root Extract, Crane's Bill Extract, Crataegus Extract, Cream, Cucumber Extract, Cucumber Juice, Cumin Extract, Curled Dock Extract, Cutaneous Lysate, Cyanocobalamin, Cypress Extract, Daisy Extract, Dandelion Root, DNA, Drosera, Drosera Extract, Dulcamara Extract, Eggplant Extract, Elm Bark Extract, Embryo Extract, English Oak Extract, Ergocalciferol, Escin, Esculin, Eucalyptus Extract, Euphrasia Extract, Everlasting Extract, Faba Bean Extract, Fennel Extract, Fenugreek Extract, Field Poppy Extract, Fig Extract, Folic Acid, French Rose Extract, Fumitory Extract, Galega Extract, Garlic Extract, Gentian Extract, Geranium Extract, Gingko Extract, Ginseng Extract, Glycyrrhetinic Acid, Goldenrod Extract, Gourd Extract, Goutweek Extract, Grape Extract, Grapefruit Extract, Grapefruit Seed Extract, Grape Juice, Grape Leaf Extract, Great Burnet Extract, Green Bean Extract Buffering Agents Aluminum Glycinate, Aluminum Lactate, Ammonium Acetate, Ammonium Carbonate, Ammonium Phosphate, Boric Acid, Calcium Phosphate, Diammonium Citrate, Diammonium Phosphate, Diethanolamine Bisulfate, Disodium Phosphate, Disodium Pyrophosphate, Ethanolamine HCl, Glycine, Potassium Bicarbonate, Potassium Biphthalate, Sodium Acetate, Sodium Aluminum Lactate, Sodium Bicarbonate, Sodium Lactate, Sodium Phosphate, Sodium Tartrate, Sodium Trimetaphosphate, Tetrapotassium Pyrophosphate, Tetrasodium Pyrophosphate Oil Absorbers Polytrap absorber (Applied Polymer Systems), Microsponge absorber (Applied Polymer Systems), Sebumase absorber (US Cosmetics), silicone elastomers (e.g., 9506 Dow Corning), Guar Gum, Nylon or other synthetic fibers Cooling Agents Menthol, Frescolate, Methyl Salicylate Heat generating agents Capsasin, Zeolites Fragrances Microencapsulated Fragrances (Giavodan), various fragrance and essential oils Antiperspirant and/or Deodorant Efficacy Enhancers Calcium Chloride, Copper Sulfate, Strontium, Aluminum Salts, Tricolsan, Cetyl Pyridinium Chloride, Phenoxyethanol, Phospholipid PTC, Chlorhexidine Salts, Citric Salts Anti-stain/Anti-oxidants Vitamin E Materials to be Added to Fragrance Encapsulants or Aluminum Salts Adenosine Phosphate, Adenosine Triphosphate, Alanine, Albumen, Aldioxa, Allantoin, Allantoin Ascorbate, Allantoin Biotin, Allantoin Calcium Pantothenate, Allantoin Galacturonic Acid, Allantoin Glygyrrhetinic Acid, Allantoin Polygalacturonic Acid, Aloe, Animal Collagen Amino Acids, Animal Elastin Amino Acids Animal Keratin Amino Acids, Arginine, Asparagine, Aspartic Acid, C10–11 Isoparaffin, C10–13 Isoparaffin, C11–12 Isoparaffin, C11–13 Isoparaffin, C12–14 Isoparaffin, Camphor, Caprylyl/Capryl Glucoside, Casein, Cetyl Betaine, Chlorodeceth-14, Cholesterol, Cocamidoethyl Betaine, Cocamidopropyl Betaine, Cocamidopropyl Hydroxysultaine, Cocamidopropyl Hydroxysultaine, Cocamidopropyl Lauryl Ether, Coco-Betaine, Coco/Oleamidopropyl Betaine, Coco-Sultaine, Cod Liver Oil, Cycteine, Cycteine HCl, Cystine, Decyl Betaine, Desamido Animal Collagen, Dicapryloyl Cystine, Diethyl Aspartate, Diethylene, Tricaseinamide, Diethyl Glutamate, Dihydrocholesterol, Dipalmitoyl Hydroxyproline, Disodium Adenosine Triphosphate, Dried Buttermilk, Dried Egg Yolk, Egg, Egg Oil, Egg Yolk, Egg Yolk Extract, Ethyl Aspartate, Ethyl Ester of Hydrolyzed Animal Protein, Ethyl Glutamate, Ethyl Serinate, Ethyl Urocanate, Folic Acid, Fructose, Glutamic Acid, Glutamine, Glyceryl Lanolate, Glycine, Glycogen, Guanosine, Hexamethyldisiloxane, Hexyl Nicontinate, Histidine, Human Placental Protein, Hyaluronic Acid, Hydrogenated Animal Glyceride, Hydrogenated Honey, Hydrogenated Palm Oil, Hydrogenated Tallow Betaine, Hydrogenated Tallowtrimonium Chloride, Hydrogenated Laneth-5, Hydrolyzed Animal Elastin, Hydrolyzed Animal Keratin, Hydrolyzed Animal Protein, Hydrolyzed Casein, Hydrolyzed Human Placental Protein, Hydrolyzed Mucopolysaccarides, Hydrolyzed Silk, Hydrolyzed Soy Protein, Hydrolyzed Vegetable Protein, Hydrolyzed Yeast Protein, Hydroxylated Lanolin, Hydroxyproline, Isobutylated Lanolin Oil, losleucine, Isostearamindopropyl Betaine, Isostearyl Diglyceryl Succinate, Keratin, Laneth-4 Phosphate, Laneth-5, Lanolinamide DEA, Lanosterol, Lard Glycerides, Lauramidopropyl Betaine, Lauryl Aminopropylglycine, Lauryl Betain, Lauryl Diethylenediaminoglycine, Lauryl sultaine, Lecithin, Leucine, Linoleic Acid, Linolenic Acid, Lysine, Magnesium Aspartate, Magnesium Lanolate, Magnesium Sulfate, MEA-Hydrolyzed Animal Protein Methionine, 2-Methyl-4-Hydroxypyrrolidine, Milk, Mixed Isopropanolamines Lanolate, Mixed Mucopolysaccarides, Monosaccharide Lactate Condensate, Myristamidopropyl Betaine, Myristyl Betaine, Niacinamide, Nonfat Dry Milk, Norvaline, Oleamidopropyl Betaine, Oleamidopropyl Hydroxysultaine, Oleyl Betaine, Orotic Acid, Palmamidopropyl Betaine, Palmitalmidopropyl Betaine, Palmitalmidopropyl Dimethyl amine, Palmitoyl Animal Collagen Amino Acids, PEG-5 Hydrogenated Lanolin, PEG-10 Hydrogenated Lanolin, PEG-2 Milk Solids, PEG-6 Soya Sterol Undecylenated, Phenylalanine, Polyglyceryl-2 Lanolin Alcohol Ether, Potassium Aspartate, Potassium Caseinate, Potassium DNA, PPG-9, PPG-12, PPG-15, PPG-17, PPG-20, PPG-26, PPG-30, PPG-34, PPG-2-Buteth-3, PPG-3-Buteth-5, PPG-5-Buteth-7, PPG-7-Buteth-10, PPG-9-Buteth-12, PPG-12-Buteth-16, PPG-15-Buteth-20, PPG-20-Buteth-30, PPG-24-Buteth-27, PPG-26-Buteth-26, PPG-28-Buteth-35, PPG-33-Buteth-45, PPG-4 Butyl Ether, PPG-5 Butyl Ether, PPG-9 Butyl Ether, PPG-14 Butyl Ether, PPG-15 Butyl Ether, PPG-16 Butyl Ether, PPG-18 Butyl Ether, PPG-22 Butyl Ether, PPG-24 Butyl Ether, PPG-30 Butyl Ether, PPG-33 Butyl Ether, PPG-40 Butyl Ether, PPG-53 Butyl Ether, PPG-2 Isostearate, PPG-10 Methyl Glucose Ether, PPG-20 Methyl Glucose Ether, PPG-20 Methyl Glucose Ether Acetate, PPG-2 Myristyl Ether Propionate, Pregnenolone Acetate, Proline, Pyridoxine, Pyridoxine Dicaprylate, Pyridoxine Dilaurate, Pyridoxine Dioctenoate, Pyridoxine Dipalmitate, Pyridoxine HCl, Pyridoxine Tripalmitate, Resorcinol Acetate, Teinol, Teinyl Acetate, Retinyl Palmitate, Ribonucleic Acid, Ricinoleamidopropyl Betaine, Salicylic Acid, Serine, Serum Albumin, Serum Proteins, Silk, Silk Amino Acids, Silk Powder, Sodium Caseinate, Sodium Chondroitin Sulfate, Sodium DNA, Sodium Gluconate, Sodium Glutamate, Sodium Hyaluronate, Sodium Lactate Methylsilanol, Sodium Laneth Sulfate, Sodium Mannuronate, Methylsilanol, Sodium PCA Methylsilanol, Sodium Riboflavin Phosphate, Sodium Urocanate, Soluble Animal Collagen, Sorbitol, Soyaethyl Morpholinium Ethosulfate, Soy Protein, Seartamidoethyl Diethylamine, Stearamidoethyl Diethylamine Phosphate, Stearamidopropyl Betaine, Stearamidopropyl Dimethyl amine, Stearyl Betaine, Sulfur, Sulfarized Jojoba Oil, Tall Oil Sterol, Tallowamidopropyl Betaine Tallowimidopropyl hydroxysultaine, Thiamine HCl, Thiamine Nitrate, Threonine, Tocopheryl Acetate, Tocopheryl Linoleate, Tocopheryl Niotinate, Tocopheryl Succinate, Tridecyl Salicylate, Tridecyl Stearate, Tryptophan, Tyrosine, Undecylenyl Alcohol, Undecylpentadecanol, Uric Acid, Urocanic Acid Vegetable Oil, Wheat Chermanidopropyl Betaine, Wheat Germanidoproyl Dimethylamine Lactate, Whey Protein Whole Dry Milk, Witch Hazel Distillate, Witch Hazel Extract

What is claimed is:

1. A dispensing system for a multi-component product, the dispensing system comprising:

a body, containing a first component of the product and having a dispensing end constructed to apply a portion of the first component to a surface; and a cap, constructed to cover said dispensing end, containing a reservoir adapted to receive a second component of the product and being constructed to apply a portion of the second component to the dispensing end prior to applying the first component to the surface.

2. The dispensing system of claim 1 wherein the first component is provided in a form selected from the group consisting of liquids, creams, gels, solids and semi-solids.

3. The dispensing system of claim 2 wherein the first component is provided in the form of a solid or semi-solid sticks, and an end surface of said stick is exposed at said dispensing end.

4. The dispensing system of claim 2 wherein the first component is provided in the form of a liquid, and said dispensing end comprises a rolling ball constructed to deliver a film of said liquid to the surface.

5. The dispensing system of claim 2 wherein the first component is provided in the form of a liquid, and said dispensing end comprises a porous applicator.

6. The dispensing system of claim 5 wherein said porous applicator comprises a foam.

7. The dispensing system of claim 2 wherein the first component is provided in the form of a gel, and the body includes a dispensing device for metering a dose of the gel to a dispensing surface at said dispensing end.

8. The dispensing system of claim 1 wherein the product is selected from the group consisting of antiperspirants, deodorants, antiperspirant/deodorants, toothpastes, sun screens, shaving preparations, aftershaves, condiments, soaps, candies, fabric softeners, laundry soaps, cosmetics, medications, paints, shoe polishes, floor cleaners, tub and tile cleaner, hair color treatments, window cleaners, and polishes and waxes.

9. The dispensing system of claim 1 wherein said second component is provided in the form of a powder or liquid.

10. The dispensing system of claim 1 wherein said second component is provided in the form of a compressed powder.

11. The dispensing system of claim 10 wherein said cap includes a dispensing device constructed to remove a portion of the powder using a grating action.

12. The dispensing system of claim 1 wherein said cap is constructed to deliver a predetermined dose of said second component onto said dispensing end when actuated by a user.

13. The dispensing system of claim 1 wherein said cap is constructed to allow the user to adjust the amount of the second component that is delivered when the cap is actuated by a user.

14. The dispensing system of claim 1 wherein said cap, as supplied to the user, contains a supply of the second component in the reservoir.

15. The dispensing system of claim 1 wherein said cap includes an inlet constructed to allow a user to charge the reservoir with a supply of the second component.

16. The dispensing system of claim 1 wherein said second component is selected from the group consisting of antiperspirant actives, fragrances, anti-stain agents, anti-irritants, antiperspirant actives, deodorant actives, antimicrobials, anti-caking agents, film formers, glide enhancers, emollients, anti-whitening agents, absorbents, binders, exfoliants, buffering agents, cooling agents, heating agents, co-salts, encapsulants, antioxidants, skin conditioning materials, humectants, reducing agents, oxidation agents, opacifying agents, and UV absorbing agents.

17. The dispensing system of claim 1 wherein said cap includes a dispensing mechanism for delivering the second component to the dispensing end.

18. The dispensing system of claim 17 wherein the dispensing mechanism is selected from the group consisting of sprays, atomizers, droppers, and powder delivery devices.

19. The dispensing system of claim 1 further comprising an actuator to allow a user to actuate application of the second component.

20. The dispensing system of claim 1 further comprising an actuator that is constructed to automatically apply the second component.

21. The dispensing system of claim 20 wherein the actuator is constructed to apply the second component when the cap is removed.

22. The dispensing system of claim 1 wherein said first and second components are reactive with each other.

23. The dispensing system of claim 1 wherein an ingredient in said first component would tend to inactivate an ingredient in said second component during storage.

24. The dispensing system of claim 1 wherein said surface comprises human skin, hair, tongue or oral cavity.

25. The dispensing system of claim 1 wherein said surface comprises a fabric, leather, or plastic.

26. A method of dispensing a multi-component product from a dispenser having a dispensing end that is covered by a cap when the dispenser is not in use and that is constructed to apply a first component of the product to a surface, comprising:

(a) removing the cap;

(b) applying a second component, contained in the cap, to the first component at the dispensing end to form the multi-component product; and (c) contacting the surface with the dispensing end to apply the multi-component product to the surface.

27. The method of claim 26 wherein the surface comprises human hair, skin, tongue or oral cavity.

28. The method of claim 26 wherein the applying step includes adjusting the amount of the second component to be applied to the dispensing end.

* * * * *